US009943740B2

(12) United States Patent
Mayers, III et al.

(10) Patent No.: US 9,943,740 B2
(45) Date of Patent: Apr. 17, 2018

(54) VARIABLE WEIGHT TRAINING BAT FOR INCREASING THE BAT SPEED OF A BATTER

(71) Applicants: Fred T. Mayers, III, Mechanicsville, VA (US); Jake Mayers, Mechanicsville, VA (US); Matthew A. Tyner, Indianapolis, IN (US)

(72) Inventors: Fred T. Mayers, III, Mechanicsville, VA (US); Jake Mayers, Mechanicsville, VA (US); Matthew A. Tyner, Indianapolis, IN (US)

( * ) Notice: Subject to any disclaimer, the term of this patent is extended or adjusted under 35 U.S.C. 154(b) by 0 days.

(21) Appl. No.: 15/011,787

(22) Filed: Feb. 1, 2016

(65) Prior Publication Data

US 2016/0220880 A1 Aug. 4, 2016

Related U.S. Application Data

(60) Provisional application No. 62/111,267, filed on Feb. 3, 2015.

(51) Int. Cl.

| | |
|---|---|
| ***A63B 69/00*** | (2006.01) |
| ***A63B 15/00*** | (2006.01) |
| ***A63B 60/04*** | (2015.01) |
| *A63B 59/50* | (2015.01) |

(52) U.S. Cl.

CPC ..... *A63B 69/0002* (2013.01); *A63B 15/00* (2013.01); *A63B 60/04* (2015.10); *A63B 59/50* (2015.10); *A63B 2069/0008* (2013.01); *A63B 2209/10* (2013.01)

(58) Field of Classification Search

CPC ..... A63B 69/0002; A63B 43/00; A63B 2069/0008; A63B 15/00; A63B 15/005; A63B 60/04; A63B 59/50

USPC ..... 473/457, 422, 437, 564–568, 451; D21/725

See application file for complete search history.

(56) References Cited

U.S. PATENT DOCUMENTS

| | | | | |
|---|---|---|---|---|
| 3,136,546 | A * | 6/1964 | Connolly | A63B 15/005 473/457 |
| 6,254,498 | B1 * | 7/2001 | Tyner | A63B 69/0002 473/422 |
| 6,254,502 | B1 * | 7/2001 | Becker | A63B 43/00 473/519 |
| 6,682,447 | B1 | 1/2004 | Black | |
| 7,198,581 | B1 * | 4/2007 | Black | A63B 15/00 473/454 |
| 8,517,866 | B2 * | 8/2013 | Williams | A63B 69/0002 473/457 |

(Continued)

*Primary Examiner* — Mitra Aryanpour

(57) ABSTRACT

A training bat for increasing the speed of the swing of a baseball batter. The training bat includes a tubular body with a first end including a grip and a sealing knob. A second end of the body includes a cavity therein with a detachable pin. The cavity within the tubular body includes a plurality of core members of various weights. A batter can vary the weight of the training bat by securing a selected core member within the cavity using the detachable pin. The pin may include a flexible clip member or a strap including hook and loop layers thereon for connecting a core member within the training bat. A knob boot extends from the knob and around the first end of the tubular body. A selected core member secured by the pin is held in a non-rotatable relationship with respect to the tubular body.

20 Claims, 8 Drawing Sheets

(56) References Cited

U.S. PATENT DOCUMENTS

| | | | | |
|---|---|---|---|---|
| 8,821,323 | B2 * | 9/2014 | Liu | A63B 69/0002 473/422 |
| 8,888,614 | B2 * | 11/2014 | Nutter | A63B 69/0002 473/422 |
| 9,095,739 | B2 | 8/2015 | Sillik | |
| 2002/0151389 | A1 * | 10/2002 | Mabry | A63B 69/0002 473/457 |
| 2002/0193187 | A1 * | 12/2002 | Bickel | A63B 69/0002 473/457 |
| 2004/0005940 | A1 * | 1/2004 | Black | A63B 15/00 473/457 |
| 2011/0034275 | A1 * | 2/2011 | Kim | A63B 15/005 473/457 |
| 2016/0220880 | A1 * | 8/2016 | Mayers, III | A63B 69/0002 473/437 |

* cited by examiner

VARIABLE WEIGHT TRAINING BAT FOR INCREASING THE BAT SPEED OF A BATTER

CROSS-REFERENCE TO RELATED APPLICATIONS

This application claims priority to provisional U.S. Application No. 62/111,267, filed Feb. 3, 2015, the contents of which is incorporated herein by reference in its entirety.

BACKGROUND OF THE INVENTION

In baseball, softball, and similar sports, it is desirable for the batter to increase their bat speed. Higher bat speed results in the transmission of more power to the ball and therefore longer distance on the batted ball. Batters are therefore constantly trying to improve the speed of their bat swing.

Accordingly, a device for improving the bat speed of batters would be highly desired by ballplayers, from youth leagues through professional leagues.

BRIEF SUMMARY OF THE INVENTION

The present invention is a training bat for increasing the speed of the swing of a baseball batter. The training bat includes a tubular body with a handle having a grip and a sealing knob at a first end. The opposing end is substantially hollow and includes a pin and an attached clip member. A knob boot extends from the knob and around the first end of the tubular body. The hollow opposing end of the tubular body of the training bat includes a storage space for a plurality of weights of various sizes therein. Individual weights may be added or removed from the opposing end to vary the weight of the bat. As a batter swings the bat during batting practice, the pin and attached clip member hold the weights securely within the opposing end of the bat.

OBJECTS AND ADVANTAGES

A first object of the invention is to provide a training bat that will increase the speed of the swing of a baseball batter.

A second object of the invention is to provide a training bat for which the weight of the bat can be easily changed.

A further object of the invention is to provide a training bat that includes a plurality of weights for enabling a batter to vary the weight of the bat.

A further object of the invention is to provide a training bat that includes an inner compartment for the storage of weights.

A further object of the invention is to provide a training bat with internally stored weights in which the weights can be removed individually or in multiples as desired by the batter.

Another object of the present invention is to provide a training bat including a plurality of removable internal weights wherein each of the weights has a unique weight.

A further object of the invention is to provide a training bat that may be manufactured at low cost.

Another object of the present invention is to provide a training bat in which the weights are safely stored within the bat during batting practice and thus will not fly off the bat during training swings.

These and other objects and advantages of the present invention will be better understood by reading the following description along with reference to the drawings.

BRIEF DESCRIPTION OF THE DRAWINGS

Reference is made herein to the accompanying drawings, which are not necessarily drawn to scale, and wherein.

DETAILED DESCRIPTION

Figure 1:
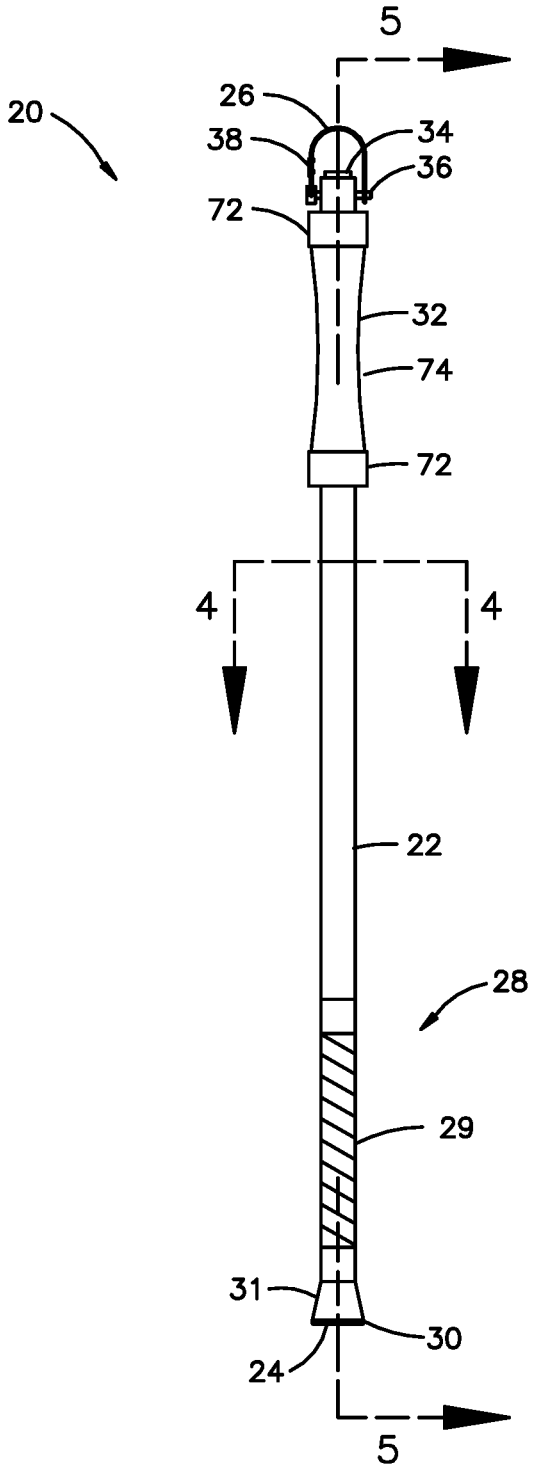
FIG. 1 is a front elevation view of a training bat according to the present invention.

Referring to FIG. 1, there is shown a training bat 20 according to the present invention. The training bat 20 includes a tubular body 22 having a first end 24 and a second end 26. The first end 24 includes a handle 28 with a grip 29. The first end 24 of the bat is sealed by a knob 30, preferably welded to the first end of the tubular body 22. A knob boot 31, preferably constructed of rubber, extends from the knob 30 and extends around the first end 24 of the tubular body. The second end 26 of the bat includes an impact pad 32 surrounding and integral with the tubular body 22. A core member or weight 34 is held within the tubular body 22 at the second end by a detachable pin 36, a portion of which weight 34 extends from the second end 26 of the tubular body 22. A flexible clip member or clip 38 is attached to the pin 36.

Figure 2:
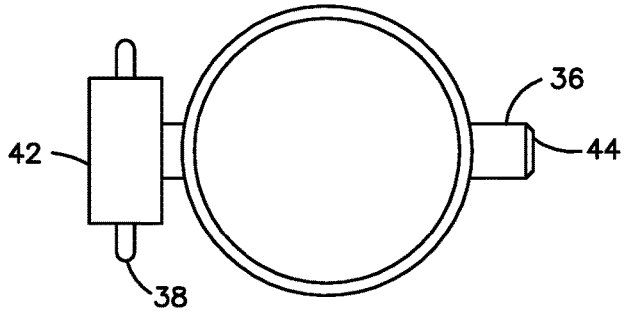
FIG. 2 is a bottom view of the training bat of FIG. 1.
Figure 4:
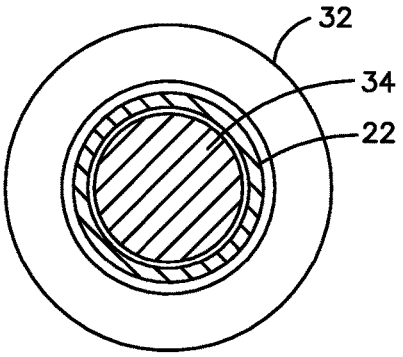
FIG. 4 is a sectional view of the training bat taken along line 4-4 of FIG. 1.
Figure 3:
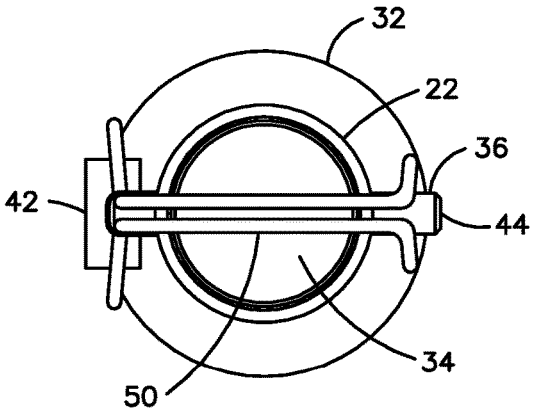
FIG. 3 is a top view of the training bat of FIG. 1.

With reference to FIGS. 2-4 the pin 36 passes through a bore 40 (see FIG. 3B) that extends through opposing sides of the tubular body 22 and through the weight 34 and secures the weight within the tubular body 22 at the second end 26. Pin 36 includes a head 42 and a distal end 44.

Figure 3A:
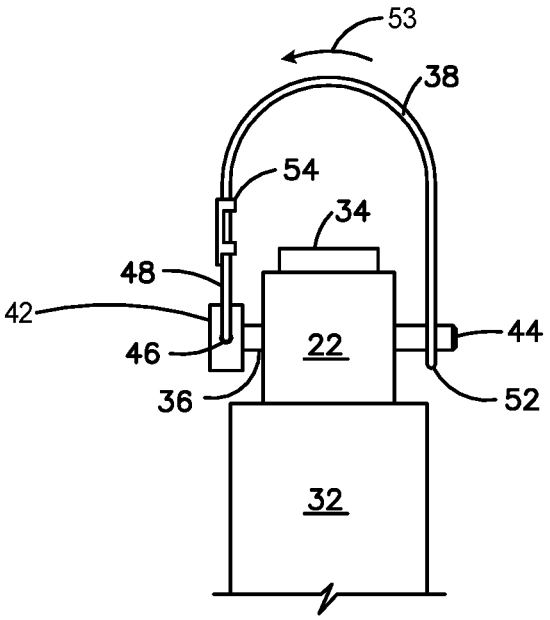
FIG. 3A is a detail elevation view of the second end of the training bat of FIG. 1.
Figure 3B:
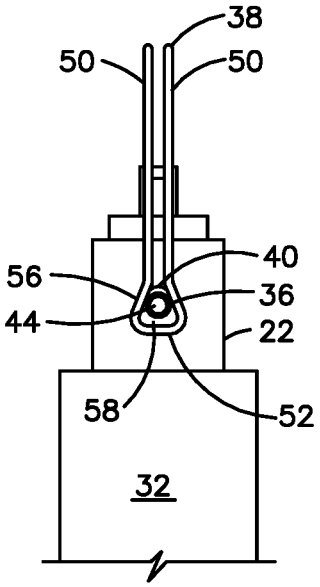
FIG. 3B is a detail elevation view of the second end of the training bat as viewed from the right side of FIG. 1.

As shown in FIG. 3A, an aperture 46 extends through pin head 42. Flexible clip 38, as shown in FIG. 3A is substantially U-shaped and includes a base end 48 that extends through the aperture 46 in pin head 42 and renders the base end 48 free to rotate with respect to the pin head. Flexible clip 38 includes parallel arms 50 (see FIG. 3B) and is preferably constructed of metal. Flexible clip 38 further includes a detachable end 52. The metal construction of the clip 38 combined with the narrow diameter of the arms 50 and the U-shape of the clip enables a user to pry the detachable end 52 of the clip off of the distal end 44 of the pin 36 as desired. Once detached, detachable end 52 of flexible clip 38 can be rotated with respect to the head 42 of the pin 36 and pin can be removed from the tubular body 22. The flexible clip 38 is rotated in the direction of arrow 53 or over the second end 26 of the bat. The clip shown in FIG. 3A is in its relaxed or unbiased shape, which holds the weight 34 firmly within the bat. A clamp 54 secures the two arms 50 together at the base end 48 of the clip 38. As shown in FIG. 3B, the arms 50 at detachable end 52 of clip 38 include flared end portions 56 that provide an opening 58 at the detachable end for accommodating the distal end 44 of pin 36 when the detachable end 52 is closed upon the pin 36.

Figure 5A:
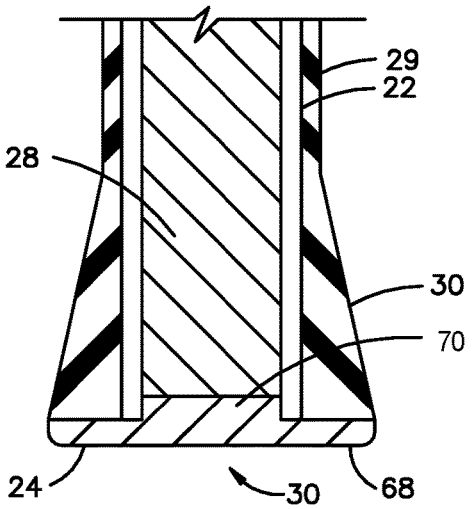
FIG. 5A is a detail view of the section of the training bat at the first end of FIG. 5.
Figure 5:
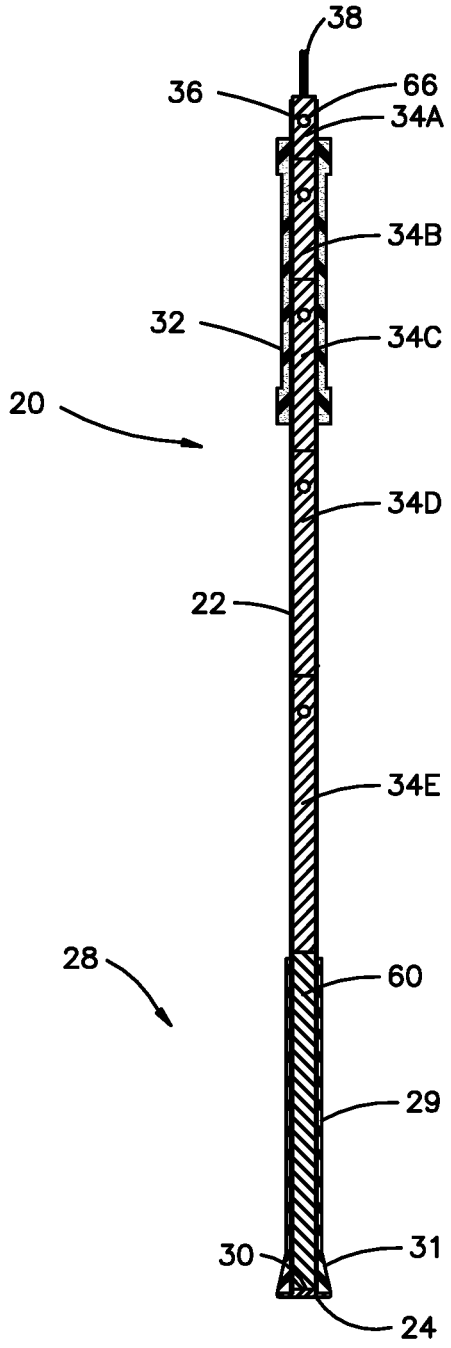
FIG. 5 is a sectional view of the training bat taken along line 5-5 of FIG. 1.

Referring to FIG. 5, the tubular body 22 of the training bat 20 includes a storage space or cavity 35 for a plurality of weights 34A-34E therein. A spacer 60, secured above the knob 30 and within the tubular body 22 at the first end 24 of the bat 20, serves to limit the movement of the weights when all the weights are stored within the bat as shown in FIG. 5.

Figure 6:
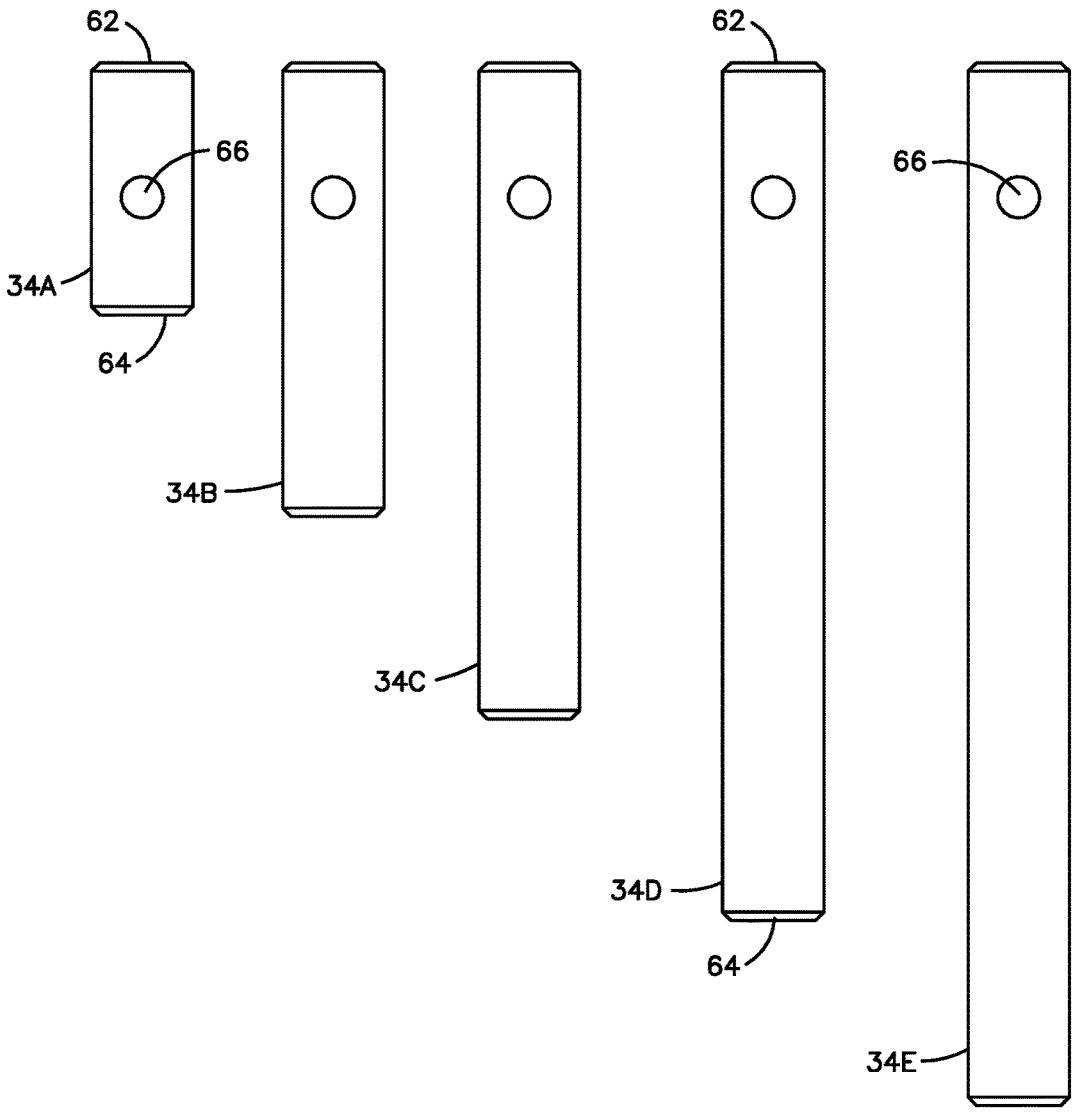
FIG. 6 is an elevation view of a series of weights that form a portion of the training bat according to the present invention.
Figure 7:
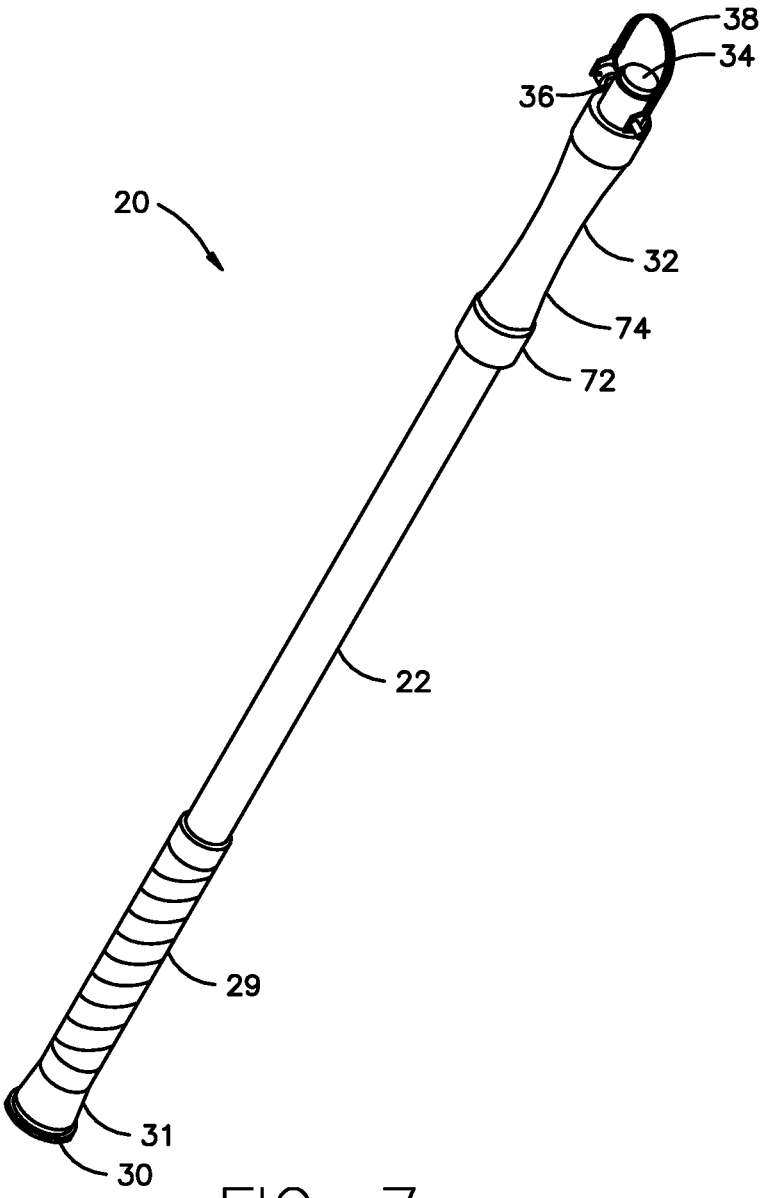
FIG. 7 is an isometric view of a training bat according to the present invention.

With reference to FIG. 6, each of the weights 34A-34E are of substantially cylindrical shape, have a diameter that substantially spans the hollow inner diameter of the cavity 35, and the weights include a first or upper end 62, a second or lower end 64, and a bore 66 therein. Preferably, each of the bores 66 in the weights is equidistant from the upper end 62 of the weight. The weights are constructed of steel and preferably are of different lengths. The weights thus vary in weight, with the smallest weight most preferably weighing 3.4 ounces, with each successively larger weight being incrementally higher in weight by 3 ounces. The weights, from lightest (34A) to heaviest (34E) weigh 3.4, 6.4, 9.4, 12.4, and 15.4 ounces respectively, from left to right 10 in FIG. 6.

As shown in FIG. 5A, the knob 30 of the bat preferably includes a flat base portion 68 that abuts the first end 24 of the tubular body 22 and a tubular nose portion 70 that extends a slight distance within tubular body 22. The knob 30 and spacer 60 may be secured to tubular body 22 by welding or similar fastening means.

The training bat 20 is used to increase the bat speed of a batter as will be described herein. When not in use, as depicted in FIG. 5, tubular body 22 includes all of the weights 34A-34E stored therein. The knob 30 seals the first end 24 of the tubular body 22 and pin 36 extends through the tubular body 22 and bore 66 in weight 34A, thereby holding all of the weights within the tubular body. Spacer 60 maintains the weights substantially flush against each other and limits the movement of the weights axially within the tubular body 22.

To operate the invention, a batter would slide the clip member 38 off of the distal end 44 of the pin 36 and remove the pin 36 from the bat assembly. To increase his or her bat speed, the batter would begin practice by removing the heavier weights 34B-34E and securing the smallest weight 34A at the second end 26 of the bat using the clip member 38 and pin 36. The batter would then sequentially progress through the remaining weights, changing to the next heavier weight at each step of the practice. Most preferably, the bat is between 31 and 35 inches in length and can be varied in weight from 25.4 ounces to 37.4 ounces in 3.0 ounce increments by sequentially progressing through the weights.

Referring to FIG. 1, while operating the invention with the selected weight 34 secured at the second end 26 of tubular body 22, the batter grips the grip 29 of handle 28, addresses the pitcher or batting machine, and swings at the pitched ball. After taking the desired number of swings with the smallest weight 34 secured by clip member 38 and pin 36, the batter would install the next higher weight and subsequently progress sequentially through each higher weight to increase his or her bat speed.

Impact pad 32 includes two wide end portions 72 and a narrower mid-portion. The surface 74 of impact pad 32 is preferably tapered, being narrower in the middle than near the end portions 72. The impact pad 32 provides a resilient contact surface for striking the pitched ball. The tapered surface 74 of impact pad 32 marks the sweet spot, or ideal striking portion, of the bat. The tapered surface 74 thus gives the batter an indication of the closeness of striking the ball at the sweet spot, as an impact at the center of the tapered surface will provide both a feel of stronger impact to the batter and also will provide an audible indication of stronger impact as an impact at the narrower center of the impact pad 32 will provide a less muffled sound that an impact at the wide end portions 72.

Preferably the tubular body 22 and knob 30 are constructed of metal, and most preferably the tubular body 22 and knob 30 are constructed of aluminum. The knob 70 is preferably welded to the first end 24 of the tubular body 22 to close and seal the first end. Most preferably, impact pad 32 is constructed of closed cell foam rubber material. The grip 29 is preferably constructed of a flexible material, such as leather or rubber tape, that is wrapped around and adhered to the handle portion of the tubular body 22. The clip member 38 is preferably constructed of a flexible metal such as spring steel.

Figure 8:
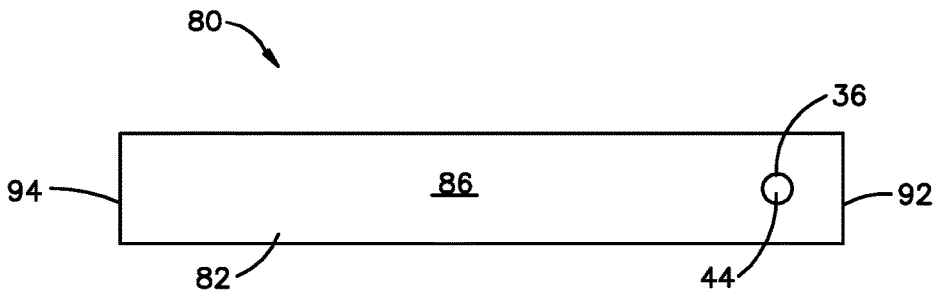
FIG. 8 is a plan view of the inner layer of a second embodiment of the detachable pin according to the present invention.
Figure 9:
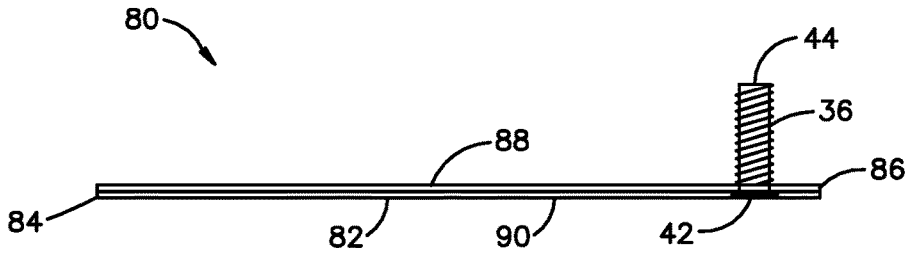
FIG. 9 is a side view of the detachable pin of FIG. 8.
Figure 10:
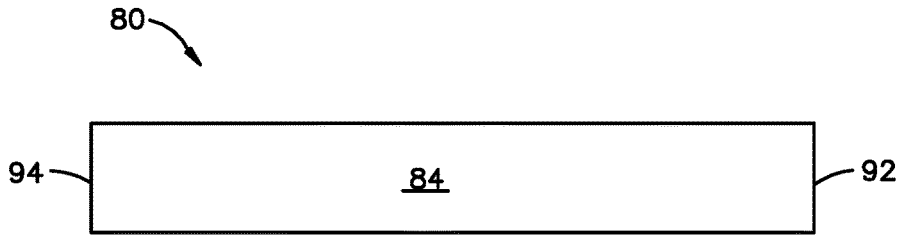
FIG. 10 is a plan view of the outer layer of the detachable pin of FIG. 8.

With reference to FIGS. 8-10, there is shown a second and preferred embodiment of a detachable pin 80 according to the present invention. The detachable pin 80 includes a strap 82 having an outer layer 84 and an inner layer 86. Detachable pin 80 further includes a pin member 36 including a head 42, and a distal end 44, with the head 42 secured between the inner 86 and outer 84 layers of the strap 82. The strap 82 preferably includes complementary hook and loop fastening material on its opposing broad surfaces. Most preferably inner layer 86 includes hook material 88 thereon and outer layer 84 includes loop material 90 thereon. Head 42 of pin is embedded between the inner 86 and outer 84 layers of the strap 82 and distal end 44 of pin 36 extends from the strap. Detachable pin 80 includes a first end 92 and second end 94.

Figure 11:
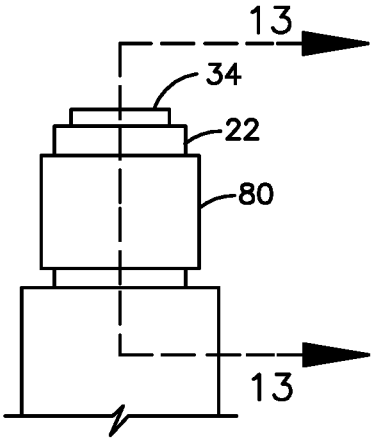
FIG. 11 is a side view of the second end of the training bat with the second embodiment of the detachable pin secured thereto.
Figure 13:
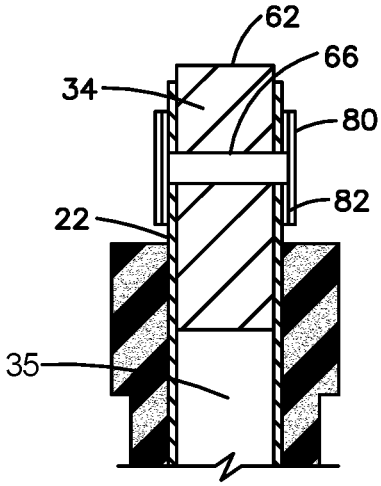
FIG. 13 is a sectional view of the second end of the training bat with the second embodiment of the detachable pin secured thereto.
Figure 12:
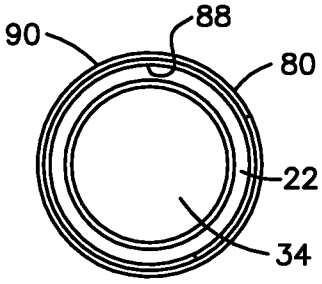
FIG. 12 is a top view of the training bat with the second embodiment of the detachable pin secured thereto and holding a core member at the top end of the bat.
Figure 14:
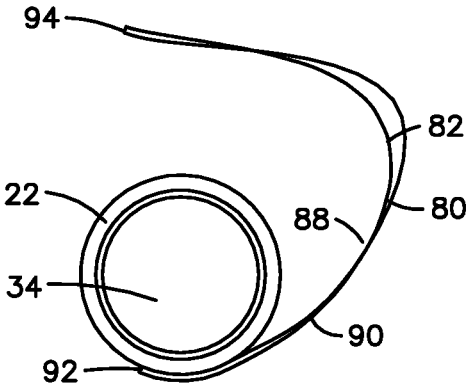
FIG. 14 is a top view of the training bat with the distal end of the second embodiment of the detachable pin unfurled from the bat.

Referring to FIGS. 11-13, detachable pin 80 is shown secured to the second end 26 tubular body 22 thus securing a core member 34 within the tubular body 22, with the core member secured at a predetermined depth determined by the depth of bore 66 from the second end 62 of the core member 34. When secured to the training bat, the strap 82 is wrapped completely around the top of the tubular body 22 with the hook material 88 fastened securely to the loop material 90 and pin 36 extends through the core member 34 thus holding the core member securely within the training bat. Core members 34A-34E, as shown in FIG. 6, can then be changed by unfurling the strap 82 portion of the detachable pin 80 as shown in FIG. 14, retracting the pin 36 from the core member 34 and tubular body 22, inserting a new core member, reinserting the pin, and wrapping the strap 82 around the tubular body.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment herein was chosen and described in order to best explain the principles of the invention and the practical application, and to enable others of ordinary skill in the art to understand the invention for various embodiments with various modifications as are suited to the particular use contemplated.

What is claimed is:

1. A training bat, comprising:

a tubular body including a first end, a second end, and an aperture at said second end;

a cavity at said second end of said tubular body;

a handle at said first end of said tubular body;

a plurality of core members slideable within said cavity from said second end;

said core members each including an upper end, a second end, and a bore extending laterally through said core member at said upper end; and a pin on said second end of said tubular body, said pin extending through a selected core member within said cavity to adjust the weight of the bat.

2. The training bat of claim 1, wherein the outermost of said core members is held in a non-rotatable relationship with respect to the tubular body.

3. The training bat of claim 1, wherein each of said core members includes a unique weight.

4. The training bat of claim 1, further comprising a clip member attached to said pin.

5. The training bat of claim 4, further comprising:

a head and a distal end on said pin;

said clip member rotatably attached at a first end to said head of said pin; and said clip detachable from said distal end of said pin.

6. The training bat of claim 1, wherein said pin secures said outermost weight non-slideably within said cavity at said second end of said tubular body.

7. The training bat of claim 1, wherein said detachable pin extends through said aperture in said body and said bore in said selected core member to secure said core member within said second end of said tubular body.

8. The training bat of claim 4, further comprising a base end and a detachable end on said clip member.

9. The training bat of claim 8, further comprising parallel arms on said clip member.

10. The training bat of claim 9, further comprising flared end portions on said detachable end of said clip member.

11. The training bat of claim 10, further comprising an opening defined by said flared end portions; said opening for accommodating said distal end of said pin.

12. The training bat of claim 1, further comprising an impact pad integral with said second end of said tubular body.

13. The training bat of claim 12, further comprising wide end portions on said impact pad.

14. The training bat of claim 13, further comprising a tapered surface on said impact surface, said tapered surface extending between said end portions.

15. The training bat of claim 1, further comprising:

a knob closing said cavity on said first end of said tubular body; and a flat base and a nose portion on said knob.

16. The training bat of claim 1, further comprising:

a spacer within said cavity at said first end of said tubular body; and a grip on said first end of said tubular body.

17. The training bat of claim 4, wherein said clip member includes a flexible strap including a base and a detachable end; and a pin secured to said base end of said strap.

18. The training bat of claim 17, wherein said strap further comprises:

an inner layer including hook material thereon; and an outer layer including loop material thereon.

19. The training bat of claim 18, further comprising:

a head and a distal end on said pin; and said pin is embedded between said outer layer and said inner layer of said strap.

20. The training bat of claim 1, wherein said bore in each of said core members is equidistant from said upper end of said core member.

* * * * *